United States Patent [19]

Ayers

[11] 4,335,274

[45] Jun. 15, 1982

[54] SOUND REPRODUCTION SYSTEM

[76] Inventor: Richard A. Ayers, 10801 De Witt Ct., El Cajon, Calif. 92020

[21] Appl. No.: 111,232

[22] Filed: Jan. 11, 1980

[51] Int. Cl.[3] ..... H04R 3/08; H04R 9/06

[52] U.S. Cl. ..... 179/1 F; 179/115.5 DV

[58] Field of Search ..... 179/1 F, 115.5 DV

[56] References Cited

U.S. PATENT DOCUMENTS

| | | | |
|---|---|---|---|
| 1,645,282 | 10/1927 | Hanna | 179/1 F |
| 2,194,175 | 3/1940 | Wilhelm | 179/1 F |
| 3,009,991 | 11/1961 | Bekey | 179/1 F |
| 3,047,661 | 7/1962 | Winker | 179/1 F |
| 3,449,518 | 6/1969 | Erath | 179/1 F |
| 3,530,244 | 9/1970 | Reiffin | 179/1 F |
| 3,798,374 | 3/1974 | Meyers | 179/1 F |
| 3,872,247 | 3/1975 | Saville et al. | 179/1 A |
| 4,243,839 | 1/1981 | Takahashi et al. | 179/1 F |

FOREIGN PATENT DOCUMENTS

| | | | |
|---|---|---|---|
| 2422309 | 12/1979 | France | 179/1 F |

*Primary Examiner*—Thomas W. Brown

*Attorney, Agent, or Firm*—Brown & Martin

[57] ABSTRACT

A speaker which is driven by an audio amplifier has a feedback coil wound on the coil mandrel adjacent to the speaker's drive coil. A first degenerative feedback element is provided for applying degenerative feedback to the audio amplifier in proportion to the current flowing through the speaker's drive coil. A second degenerative feedback elements is provided for applying degenerative feedback to the audio amplifier in proportion to the voltage induced in the feedback coil. The first and second degenerative feedback elements are arranged to be additive so that the total degenerative feedback applied to the audio amplifier is equal to the sum of the degenerative feedback from both degenerative feedback elements to thereby prevent acoustical peaks from being produced in the audio spectrum of the speaker.

11 Claims, 5 Drawing Figures

SOUND REPRODUCTION SYSTEM

BACKGROUND OF THE INVENTION

In the past, feedback coils have been wound on the coil mandrels of speakers and have been used to apply degenerative feedback in an audio amplifier driving the speaker as disclosed in U.S. Pat. No. 3,530,244 which issued to M. G. Reiffin on Sept. 22, 1970, for "Motional Feedback Amplifier Systems." However, such feedback has not proven to be commercially successful because it does not remedy the basic defects in the lower frequency response of the speaker.

SUMMARY OF THE INVENTION

In accordance with the present invention, it has been found that the basic defects in the lower frequency response of a speaker can be remedied by adding the degenerative feedback from a separate feedback coil to degenerative feedback which is proportional to the current flowing through the speaker's drive coil. It has been found that the combined degenerative feedback will accomplish what the individual degenerative feedbacks taken separately will not.

A speaker which is driven by an audio amplifier has a separate feedback coil wound on the mandrel which supports the speaker's drive coil. A first degenerative feedback element is provided for applying degenerative feedback to the audio amplifier proportional to the current flowing through the drive coil. A second degenerative feedback element is provided for applying degenerative feedback to the audio amplifier proportional to the voltage induced in the feedback coil. The first and second degenerative feedback elements are arranged to be additive so that the total degenerative feedback applied to the audio amplifier is equal to the sum of the degenerative feedback from both degenerative feedback elements. Some of the beneficial results of the invention are lower harmonic and intermodulation distortion, a smooth resonance-free acoustic output, and useful acoustical output over the entire audio spectrum from a single acoustical radiator.

DESCRIPTION OF THE PREFERRED EMBODIMENT

Figure 1:
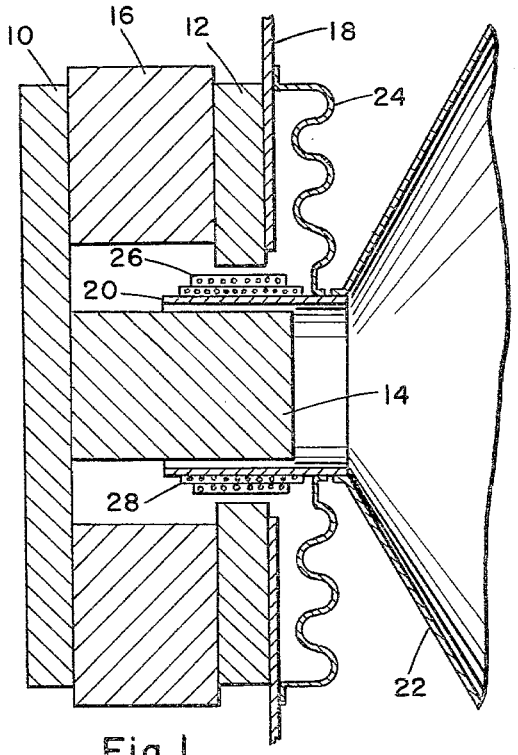
FIG. 1 is a cross-sectional view of a speaker having a feedback coil wound on the coil mandrel under the drive coil.

FIG. 1 shows a speaker having a circular rear pole piece 10, a circular front pole piece 12 having an open center, a cylindrical flux return slug 14 in the open center of the pole piece 12, and a circular magnet 16 having an open center surrounding the flux return slug 14. The above described magnet 16 and its associated pole pieces 10, 12, and 14 are mounted on a conventional basket 18 one fragment of which is shown in FIG. 1 and the remainder of which is omitted from the drawing. A hollow split cylindrical coil mandrel 20 which supports the center of an acoustic cone 22 is supported in the air gap between the front pole piece 12 and the cylindrical flux return slug 14 by a flexible convoluted suspension of a spider 24 which is attached at its outer periphery to the basket 18 and is attached at its inner periphery to the coil mandrel 20. Two coils are wound on the coil mandrel 20. These two coils are the speakers drive coil 26, and a feedback coil 28. The feedback coil 28, which includes the smaller wire of the two coils, is wound directly on the mandrel 20, while the drive coil 26 is wound on top of the feedback coil 28. The arrangements of the coils 26 and 28 could, however, be reversed if desired without changing the electrical characteristics of the circuit. In other words, the drive coil 26 could be wound on the mandrel 20 and the feedback coil 28 could be wound on top of the drive coil 26. It is important to have the feedback coil 28 located in the air gap between the front pole piece 12 and the flux return slug 14 so that the motion of the mandrel 20 and the cone 22 will induce the maximum voltage in the feedback coil 28 proportional to the motion of the cone 22.

Figure 2:
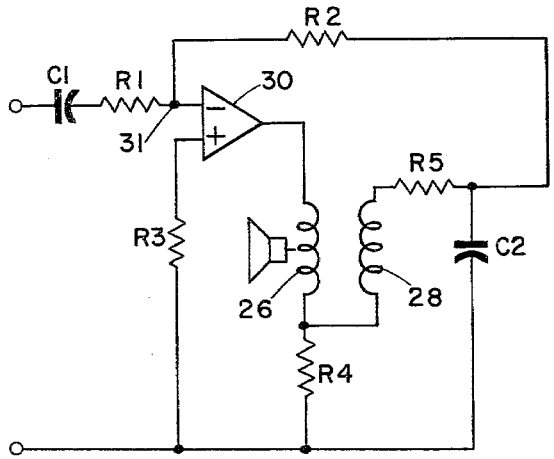
FIG. 2 is a schematic circuit diagram of the preferred embodiment of the invention.

FIG. 2 shows the electrical connections for the preferred embodiment of the invention. An audio signal input is applied through a coupling capacitor C1 and an input resistor R1 to an audio power amplifier 30 which has inverting (−) and non-inverting (+) inputs. The input resistor R1 is coupled to the inverting input of amplifier 30 while the non-inverting input is grounded through a bias resistor R3. Degenerative feedback is applied to the inverting input of the amplifier 30 at a summing junction 31 through the feedback resistor R2 from a feedback network which is described hereinafter. The output of the amplifier 30 is applied to a series circuit consisting of the speaker drive coil 26 and a resistor R4, which is a current sensing resistor that develops a voltage drop proportional to the current flow through the drive coil 26 for feedback purposes. The current sensing resistor R4 is the first degenerative feedback element in this embodiment of the invention.

Figure 3:
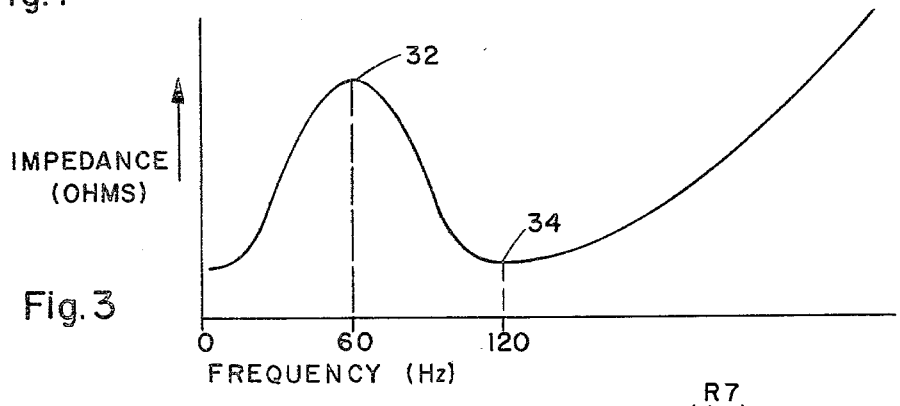
FIG. 3 is a graph showing the impedance of the speaker of FIG. 1 at the low frequency range.

The current sensing resistor R4 is also coupled in series with the feedback coil 28 which is coupled in series with a feedback resistor R2 through a stabilization network consisting of a resistor R5 and a capacitor C2. The resistor R5 and the capacitor C2 serve to roll off the high end of the feedback signal to prevent oscillation. Additional signal shaping and frequency stabilization networks (not shown) can be inserted in the feedback loop. The feedback coil 28 is connected so that the voltage developed there-across is additive to the feedback voltage developed across the current sensing resistor R4. The combined feedback voltage is applied to the input of the amplifier 30 through the resistors R5 and R2 and summing junction 31 to provide combined degenerative feedback which overcomes the two basic flaws in the speaker's impedance curve at the low end of its range, namely an impedance peak 32 (FIG. 3) caused by a mechanical resonance of the speaker's moving parts, and an impedance valley 34 (FIG. 3) caused by an electromechanical resonance in the series circuit comprising the electrical self inductance of the drive coil 26 and the apparent capacitance of the moving mass due to the cone 22, the mandrel 20, and the coils 26 and 28. The way in which these two basic defects which cause peaked acoustical output and consequently unnatural coloration in the speaker's sound, are overcome is described below.

Generally, in the upper audio frequency range (1,000 to 20,000 Hertz), the feedback signal from the current sensing resistor R4 predominates because the voltage induced in the feedback coil 28 is minimal since the excursions of the cone 22 are small in the upper audio frequency range. At low frequencies (15 to 200 Hertz), where mechanical resonance occurs due to cone mass and suspension characteristics, the drive coil 26 appears as a high impedance to the amplifier, and the negative current feedback loop, if used alone, would try to maintain the drive coil current at a near constant level. This would result in an exagerrated acoustical peak at the region of mechanical resonance, and for this reason, negative current feedback cannot be used alone over the complete audio spectrum. However, the induced voltage in the feedback coil 28 is maximum at mechanical resonance since the excursion of the cone 22 is largest at mechanical resonance. Because the current sensing resistor R4 and the feedback coil 28 are connected in an additive relation, the induced voltage from the feedback coil 28 provides the amplifier 30 with the necessary negative feedback signal to maintain a smooth or constant cone movement in the region of mechanical resonance i.e. at peak 32 in FIG. 3.

Another resonance exists and is electromechanical in nature, as a result of the series circuit comprising the electrical self-inductance of the drive coil 26 and the apparent capacitance of the moving mass due to the cone 22 and the coil assembly. The domain of this frequency is usually referred to as the "valley" region 34 (FIG. 3) of a loud speaker's impedance curve. Here the drive coil 26 appears nearly resistive, thereby appearing as a low impedance load to the amplifier 30, i.e. 2.5 ohms. A conventional power amplifier is a constant voltage device with an output impedance of a few tenths of an ohm. Because the two coils 26 and 28 are wound closely over each other, a mutual coupling inductance exists, and at the valley region the feedback coil 28 is loaded by this mutual coupling to the drive coil 26 which is tied to a low impedance amplifier. As a consequence, the induced voltage across the feedback coil 28 is reduced to a very low level, which results in an acoustical peak in the speaker's output when virtually no negative feedback signal is applied to the summing junction 31 of the amplifier 30. But the negative current feedback from the current sensor resistor R4 raises the output impedance of the amplifier 30 by orders of magnitude, which reduces the loading on the feedback coil 28, thereby allowing more negative feedback voltage to appear across its terminals. Also, in the valley region, the amplifier current would try to increase because of the low impedance load presented to it, but the negative feedback from the current sensing resistor R4 prevents this from occurring.

Thus, it can be seen that the two forms of degenerative feedback work together to remedy both the acoustical peak caused by the impedance peak 32 and the acoustical peak caused by the impedance valley 34, which result from inherent resonances in speaker construction and in the conventional means of driving the speaker. As a result, a single cone is used to provide a smooth non-distorted acoustical output over the entire audio frequency range instead of requiring several different-sized speakers for this purpose. Either form of degenerative feedback taken by itself would not produce the result that is achieved by the two forms taken in additive relation to each other. Some of the beneficial results are lower harmonic and intermodulation distortion, a smooth resonance-free acoustical output, and useful acoustical output over the entire audio spectrum from a single acoustical radiator.

Figure 4:
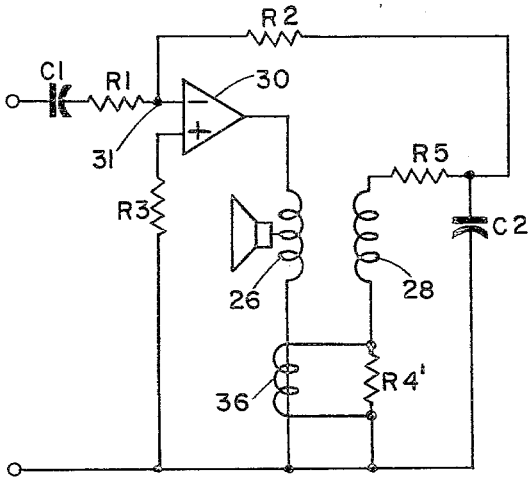
FIG. 4 is a schematic circuit diagram of a first modification of the circuit of FIG. 2.

FIG. 4 shows a first modified form of the preferred embodiment. In this modification, the current through the speaker's drive coil 26 is sensed by current transformer 36 which is terminated by a resistor $R4^1$. The resistor $R4^1$ is connected in series with the feedback coil 28 as in the case described above and serves the same function as described above.

Figure 5:
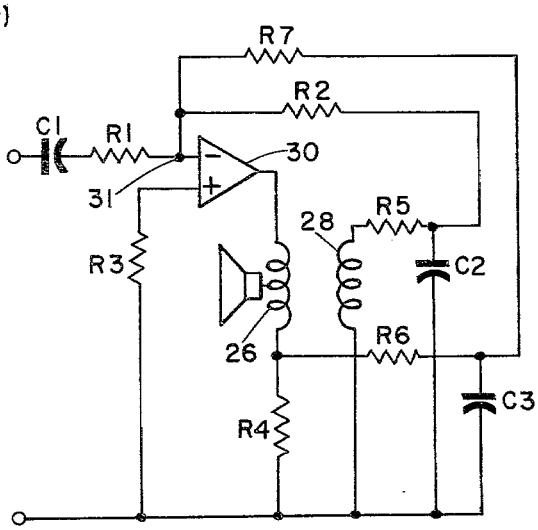
FIG. 5 is a schematic circuit diagram of a second modification of the circuit of FIG. 2.

In a second modified form of the preferred embodiment of the invention, shown in FIG. 5, the degenerative feedback from the current sensing resistor R4 is applied through a stabilization network comprising a stabilization resistor R6 and a stabilization capacitor C3 and a feedback resistor R7 to a summing junction 31 where it is summed with the degenerative feedback from the feedback coil 28 before being applied to the input of the amplifier 30. In this case, the two feedback paths are in parallel up to their point of summation, but the end result is the same as when the summation is performed in a series circuit.

Having described my invention I claim:

1. A sound reproduction system having an audio amplifier and a speaker coupled to the output of the audio amplifier, said speaker having an acoustic cone and a coil mandrel with a drive coil wound thereon, characterized by first feedback means for applying degenerative feedback to said audio amplifier in proportion to the current flowing through said drive coil;

a feedback coil wound either under or over said drive coil on said coil mandrel;

second feedback means including said feedback coil for applying degenerative feedback to said audio amplifier in proportion to the voltage induced in said feedback coil by the motion at the speaker cone; and said first and second feedback means being arranged in an additive relationship so that the total degenerative feedback applied to said audio amplifier is proportional to the sum of the output of said first and second feedback means for preventing acoustical peaks from being produced in the audio spectrum of said speaker by either a peak in the impedance versus frequency characteristic curve of said drive coil caused by a mechanical resonance of said speaker's moving parts or a valley in said curve caused by an electromechanical resonance in the series circuit comprising the electrical self-inductance of said drive coil and the apparent capacitance of the moving mass due to said cone, said mandrel and said coils.

2. The sound reproduction system defined in claim 1, wherein said first feedback means includes a current sensing resistor corrected in series with said drive coil, and wherein said current sensing resistor is coupled in series with said feedback coil.

3. The sound reproduction system defined in claim 2, also including a feedback resistor coupled in series with said current sensing resistor and said feedback coil.

4. The sound reproduction system defined in claim 3, also including a stabilization resistor coupled in series with said current sensing resistor, said feedback coil and said feedback resistor, and a stabilization capacitor coupled in parallel with the series combination of said current sensing resistor, said feedback coil, and said stabilization resistor.

5. The sound reproduction defined in claim 1, wherein said first feedback means includes a current transformer coupled to said drive coil to sense the current flow therethrough and a current sensing resistor coupled to terminate said transformer, and wherein said resistor is coupled in series with said feedback coil.

6. The sound reproduction defined in claim 5, also including a feedback resistor coupled in series with said current sensing resistor and said feedback coil.

7. The sound reproduction system defined in claim 6, also including a stabilization resistor coupled in series with said current sensing resistor, said feedback coil, and said feedback resistor, and a stabilization capacitor coupled in parallel with the series combination of said current sensing resistor, said feedback coil, and said stabilization resistor.

8. The sound reproduction system defined in claim 1, wherein said first feedback means includes a current sensing resistor coupled in series with said drive coil, also including a summing junction, wherein the signal developed across said current sensing resistor is summed with the signal induced in said feedback coil at said summing junction.

9. The sound reproduction system defined in claim 8, also including a first feedback resistor coupled in series with said feedback coil and a second feedback resistor coupled in series with said current sensing resistor.

10. The sound reproduction system defined in claim 9, also including a first stabilization network coupled with said feedback coil and a second stabilization network coupled with said current sensing resistor.

11. Apparatus for counteracting the deleterious acoustical effects of an impedance peak and an impedance valley in the lower frequency end of the impedance versus frequency characteristic curve of a sound reproduction system which includes a speaker having an acoustic cone and a coil mandrel with a drive coil wound on the coil mandrel and an audio amplifier coupled to the drive coil, said apparatus comprising:

first feedback means for applying degenerative feedback to said audio amplifier in proportion to the current flowing through said drive coil;

a feedback coil wound under or over said drive coil on said coil mandrel;

second feedback means including said feedback coil for applying degenerative feedback to said audio amplifier in proportion to the voltage induced in said feedback coil by the motion of the speaker cone; and said first and second feedback means being arranged in an additive relationship such that the total degenerative feedback applied to said audio amplifier is proportional to the sum of the output of said first and second feedback means for causing said second feedback means to compensate for the deficiencies of said first feedback means at said impedance peak and for causing said first feedback means to compensate for the deficiencies of said second feedback means in said impedance valley to provide a smooth acoustical output in the frequency range of said impedance peak and impedance valley.

* * * * *

UNITED STATES PATENT AND TRADEMARK OFFICE

CERTIFICATE OF CORRECTION

PATENT NO. : 4,335,274

DATED : June 15, 1982

INVENTOR(S) : Richard A. Ayers

It is certified that error appears in the above-identified patent and that said Letters Patent are hereby corrected as shown below:

Column 4, Claim 2, line 56, please change "corrected" to --connected--.

Signed and Sealed this

*Twenty-fourth* Day of *August 1982*

[SEAL]

*Attest:*

GERALD J. MOSSINGHOFF

*Attesting Officer*

*Commissioner of Patents and Trademarks*